United States Patent [19]

Medeot

[11] Patent Number: 4,637,656

[45] Date of Patent: Jan. 20, 1987

[54] WATER JET SCARIFYING APPARATUS

[75] Inventor: Renzo Medeot, Mossa, Italy

[73] Assignee: FIP Industriale S.p.A., Selvazzano Dentro Padova, Italy

[21] Appl. No.: 746,954

[22] Filed: Jun. 20, 1985

[30] Foreign Application Priority Data

Jul. 3, 1984 [IT] Italy ..... 21737 A/84

[51] Int. Cl.[4] ..... E21C 25/60; E01C 23/12

[52] U.S. Cl. ..... 299/1; 299/36; 299/17; 299/64; 404/91

[58] Field of Search ..... 299/1, 36, 16, 17, 64; 173/42; 403/122; 404/90, 91

[56] References Cited

U.S. PATENT DOCUMENTS

| | | | |
|---|---|---|---|
| 3,347,597 | 10/1967 | Holifield | 299/36 |
| 3,539,234 | 10/1970 | Rapata | 403/122 X |
| 3,598,446 | 8/1971 | Hatcher | 51/176 X |
| 3,790,214 | 2/1974 | Kilroy | 299/17 X |
| 3,923,341 | 12/1975 | Miller | 299/39 X |
| 4,081,200 | 3/1978 | Cheung | 299/36 X |
| 4,473,319 | 9/1984 | Spangler | 299/1 X |

FOREIGN PATENT DOCUMENTS 1959736 11/1970 Fed. Rep. of Germany ..... 299/17

OTHER PUBLICATIONS

Mitsui Mining Co., Ltd., "Hydraulic Mining", 6/1975.

*Primary Examiner*—Stephen J. Novosad
*Assistant Examiner*—Michael A. Goodwin
*Attorney, Agent, or Firm*—Bucknam and Archer

[57] ABSTRACT

Apparatus for the removal of layers of concrete, particularly from roadways and motorways. This apparatus includes nozzles positioned at one end of respective hollow shafts supported by a ball joint and mounted on movable supports. The said nozzles are supplied with water by means of a high pressure pump upstream of which there are positioned preliminary treatment systems for treating the water itself. The nozzles, moreover, are mounted on a slide controlled by electronic apparatus operable to maintain them at a predetermined height with respect to the surface to be scarified. Means are also provided for the elimination of possible hindrances to the free downflow of the water jets against the surface to be scarified.

4 Claims, 4 Drawing Figures

WATER JET SCARIFYING APPARATUS

BACKGROUND OF THE INVENTION

The present invention relates to apparatus for effecting scarification of surfaces such as concrete by means of water jets.

As is known, the possibility of cutting or piercing stone materials, and in particular, concrete, with water jets at high pressure or, rather, at high velocity has been studied in an experimental way.

Only recently, however, has the problem of the scarification of concrete with jets of water been considered, for the purpose of the removal of a layer of constant (or variable) thickness from a flat or curved surface. It is likewise known that much research has been conducted in an attempt to try and resolve this problem but with little success, attributable largely to the instability of the water jets and an incorrect distance between the jets and the surface to be scarified, as well as to the lack of movement of the nozzles themselves. It is known that the instability of the jets manifests itself as the formation of surface waves which lead to the production of drops or droplets the energy of which is rapidly dissipated into the air due to the high surface-to-volume ratio.

This phenomen is encouraged by various parameters such as: the high eflux velocity; the small diameter of the jet; the sharp variations in cross-section; the presence of gas in solution; etc. Moreover, the possible presence of sand particles in the water used leads, especially in the high pressure compression units, to a rapid wear of the units themselves.

OBJECTS OF THE INVENTION

A primary object of the present invention is that of eliminating the previously listed disadvantages.

A further object of the invention is to provide hydraulic scarification apparatus which can operate with relatively low output jet speeds but with a high capacity.

Another object of the present invention is that of providing hydraulic scarification apparatus in which the nozzles are movable with suitable traversing and/or rotation movements as well as advancing movements.

Another object of the present invention is that of providing hydraulic scarification apparatus which ensures the maximum stability of the jets, avoiding processes which lead to the formation of sprays.

A further object of the present invention is that of providing hydraulic scarification apparatus in which the jets are maintained constantly at an optimum distance from the surface to be scarified.

SUMMARY OF THE INVENTION

According to the present invention hydraulic scarification apparatus comprises essentially a nozzle positioned at one end of a hollow shaft supported by a ball joint and mounted in a device for effecting movement of the nozzle over the surface to be scarified; such nozzle being supplied with high pressure pump water upstream of which there is positioned a de-gassing and, possibly, filtering system; the said nozzle, moreover being mounted on a slide controlled by electronic apparatus operable to maintain it constantly at a predetermined height with respect to the surface to be scarified;

means being provided for the elimination of possible impediments to the free flow of the water jet against the surface to be scarified.

Further characteristics and advantages of the hydraulic scarification apparatus of the present invention will be better understood from a reading of the following description of a preferred embodiment of the apparatus which is illustrated, purely by way of indicative and non limitative example, in the various Figures of the attached drawings, to which the following description relates.

DESCRIPTION OF THE PREFERRED EMBODIMENT

Figure 1:
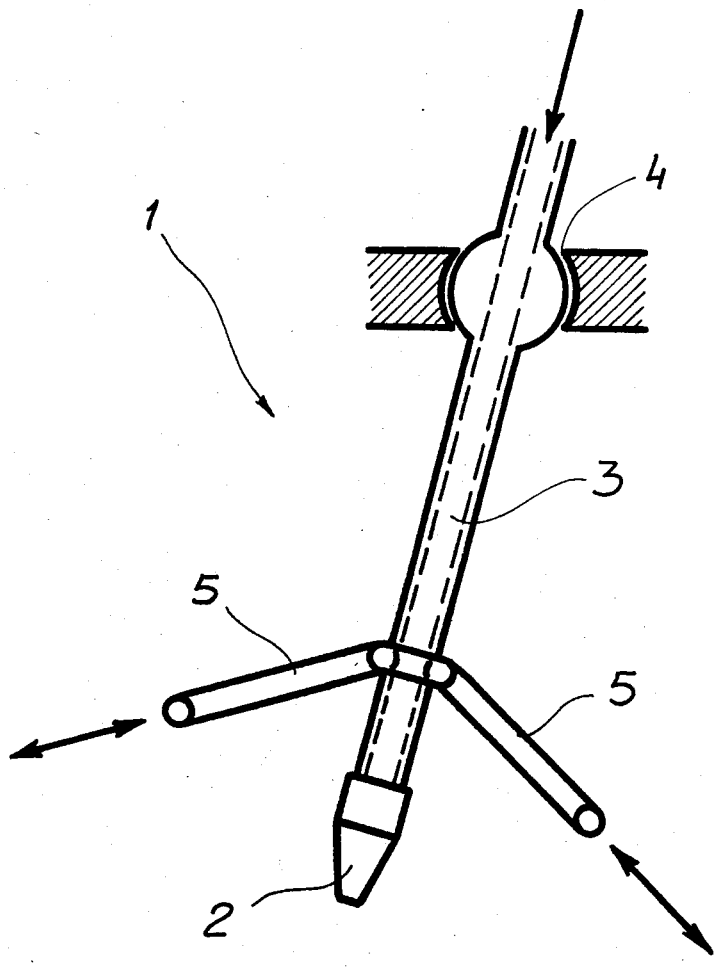
FIG. 1 is a schematic diagram illustrating the scarification head forming part of the embodiment of the present invention, showing the support and movement of the structure.

The hydraulic scarification apparatus shown in the drawings is generally indicated with the reference numeral 1 and includes a nozzle 2 mounted at one end of a hollow shaft 3 supported by a ball joint 4 in such a way as to be able to follow displacements which are applied to it by an appropriate movement device 5 which may include links, cams and the like. Alternatively, the ball joint 4 could be a Cardan joint. By means of this arrangement cyclic movements of any type can be obtained, which may be rectilinear (traversing), circular, elliptical or other movements which allow the most appropriate "figure" of movement to be impressed on the nozzle to effect the required scarification.

In particular, the said nozzle, which is preferably made of sintered material, has a convergent/divergent shape in longitudinal section, similar to a venturi tube.

Figure 2:
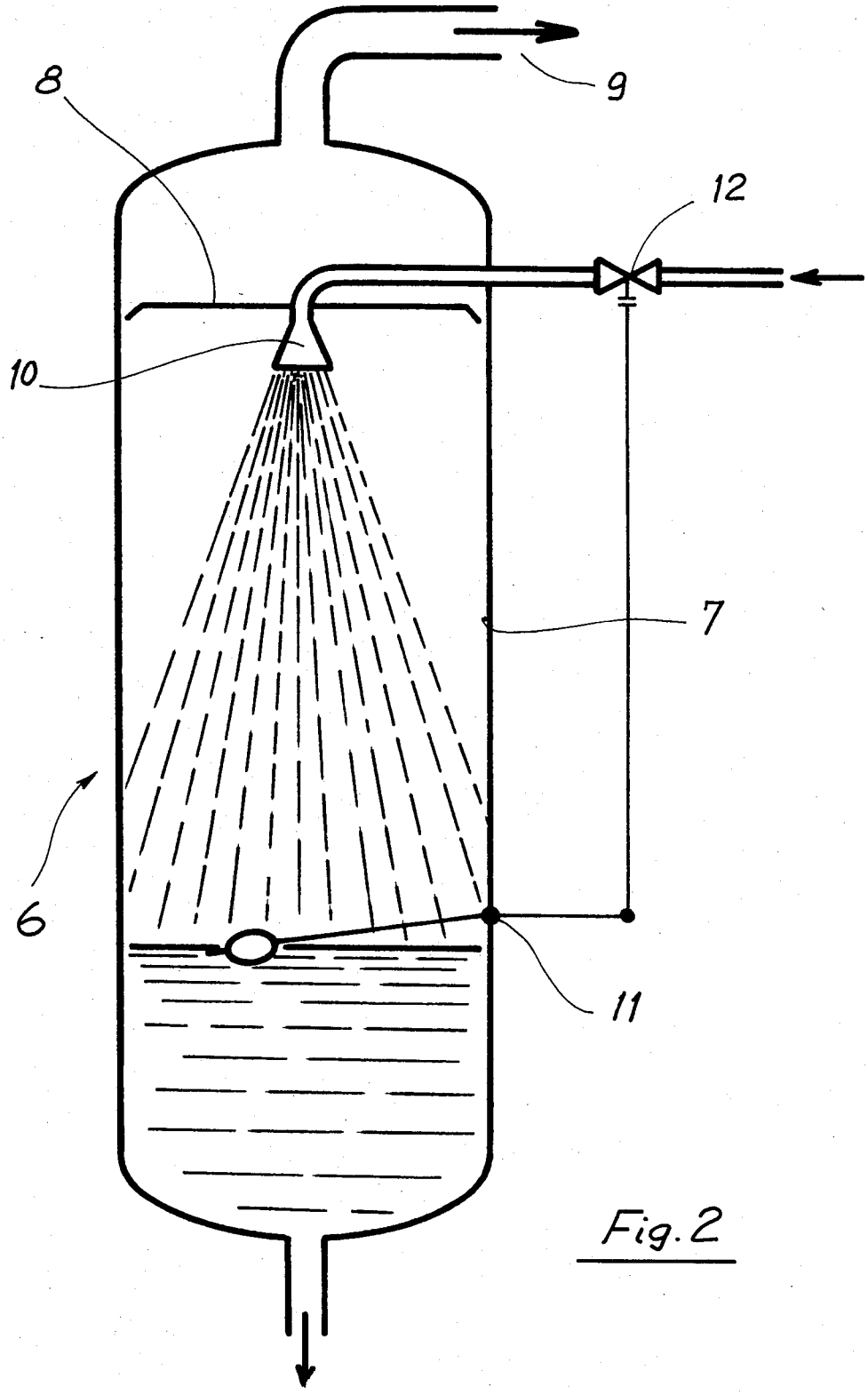
FIG. 2 is a schematic diagram representing the degassing system for preliminary treatment of the water to be forwarded to the supply pump.

For the purpose of avoiding the detrimental effects of the presence of gas which cause the development within the interior of the nozzle, at the point of minimum pressure, of water droplets and/or bubbles tending to fragment the jet, it is arranged that the water utilised is de-gassed by means of a suitable system 6 positioned upstream of the high pressure pump (which is not specifically illustrated). This de-gassing system is shown in FIG. 2 and includes a reservoir 7 of particular elongate form containing a screen 8 operable to inhibit the passage to a suction device 9 (made by means of suitable apparatus of known type), of water droplets produced by a spray head 10.

Within the said reservoir, moreover, there is provided a level regulator 11 which acts on a water inlet valve 12 in such a way as to maintain the water at an almost constant level in the reservoir. In practice, since the solubility of gas in the liquid is inversely proportional to the temperature and directly proportional to the pressure, by bringing the water, by means of this system, distinctly beneath atmospheric pressure (the source of water is supposed to be a river or a lake etc.,) there is a significant release of gas; the spray of water by means of the spray head 9, likewise, increases the exchange surface and therefore the speed of release of the gas dissolved in it.

Figure 3:
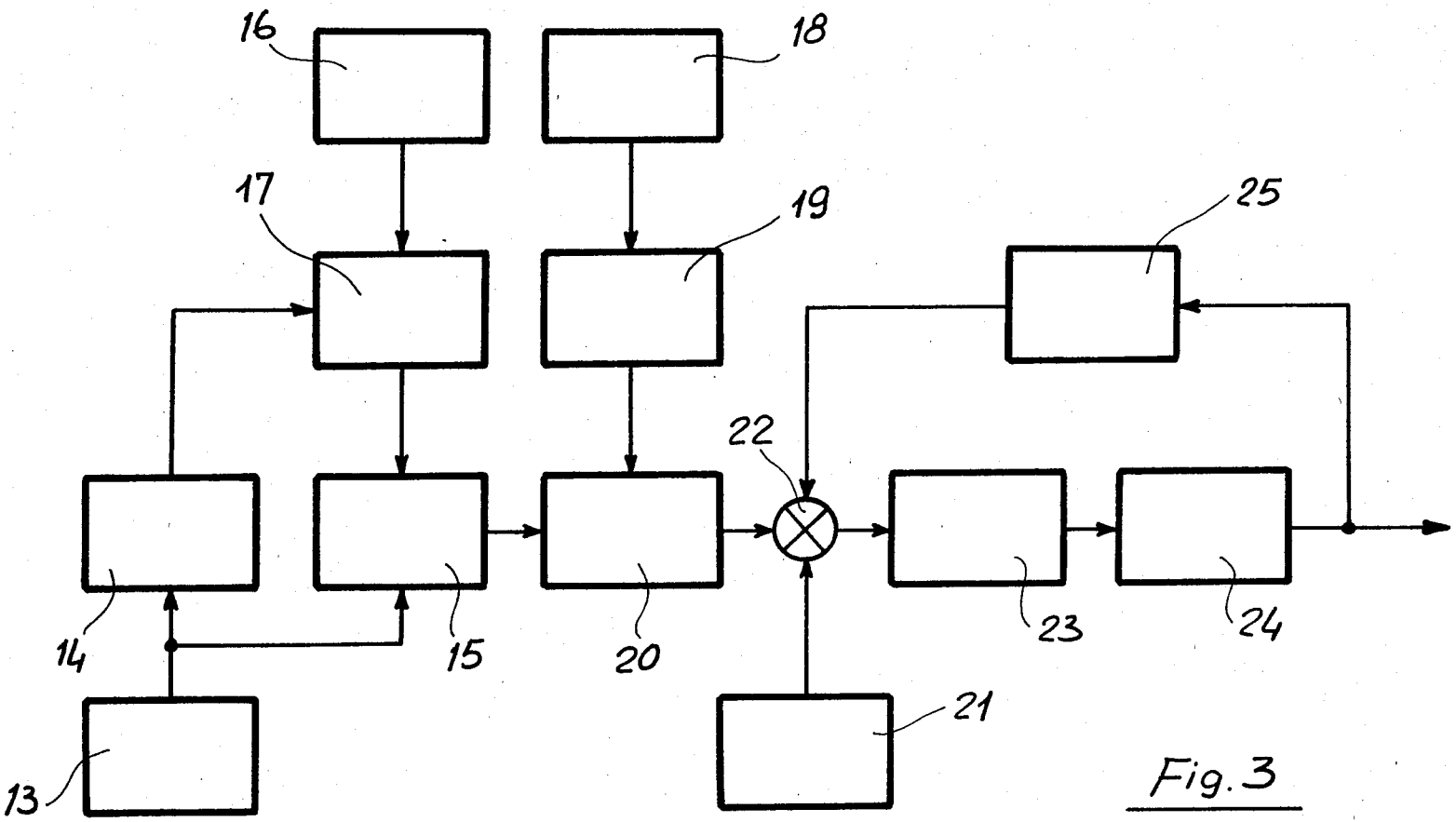
FIG. 3 is a block schematic diagram illustrating the apparatus for regulation of the height of the scarification head above the surface to be scarified.

It is suitable to underline, moreover, the fact that by moving the nozzle closer to or further from the surface to be scarified the efficiency of the jet varies. On the other hand the surface to be scarified can have significant irregularities so that, in the absence of a specific positioning system for preventing damage to the nozzle, it is necessary to operate at a safe distance proportional to the size of the departure from planarity encountered on the concrete surface. This spacing, however, causes a reduction in the efficiency and a resultant scarification process which varies from point to point. For the purpose of eliminating this limitation, the present invention includes means, of which FIG. 3 illustrates a block schematic diagram, serving the function of positioning the nozzle-carrying slide at a predetermined (minimum) height from the concrete independently of its surface configuration.

This apparatus includes a height transducer 13 which is positioned in advance of the nozzle (in the direction of advancing movement thereof) to detect the shape of the underlying surface which is to be "hydro-demolished" in the successive pass. The output signal from the transducer 13, which is proportional to the height of the slide, is fed to a minimum detector circuit 14 and to a sample and hold circuit 15. The said minimum detector circuit, together with a slide displacement transducer 16, controls a circuit 17 which in turn controls the sampling of the signal proportional to the height when this, and therefore the height of the slide itself, is at a minimum. This sampling takes place by means of the said sample and hold circuit 15. During the advancing movement of the apparatus, a transducer 18 controls a circuit 19 which determines the sampling of the minimum height of the preceding pass. This sampling is effected by means of a further sample and hold circuit 20 at the output of which, therefore, for the whole of the displacement of the slide, there will be a signal proportional to the minimum detected height. During this pass, the circuit 14 samples the minimum height value for the next pass.

There is likewise provided a component 21 for generating a reference signal representing the minimum height of the slide, which, together with the said circuit 20 sends a signal to a comparator 22 constituting an integral part of a regulation system including a three-state logic control apparatus 23, a fluid-pressure actuator 24, and a transducer 25 for controlling the height of the slide in relation to the apparatus as a whole.

It will be appreciated that the concrete detritus and the water itself which remain in the jet operating zone drastically reduce its effectiveness. In this connection a primary measure is provided in the present invention for avoiding this disadvantage, by virtue of the movement of the jet.

Figure 4:
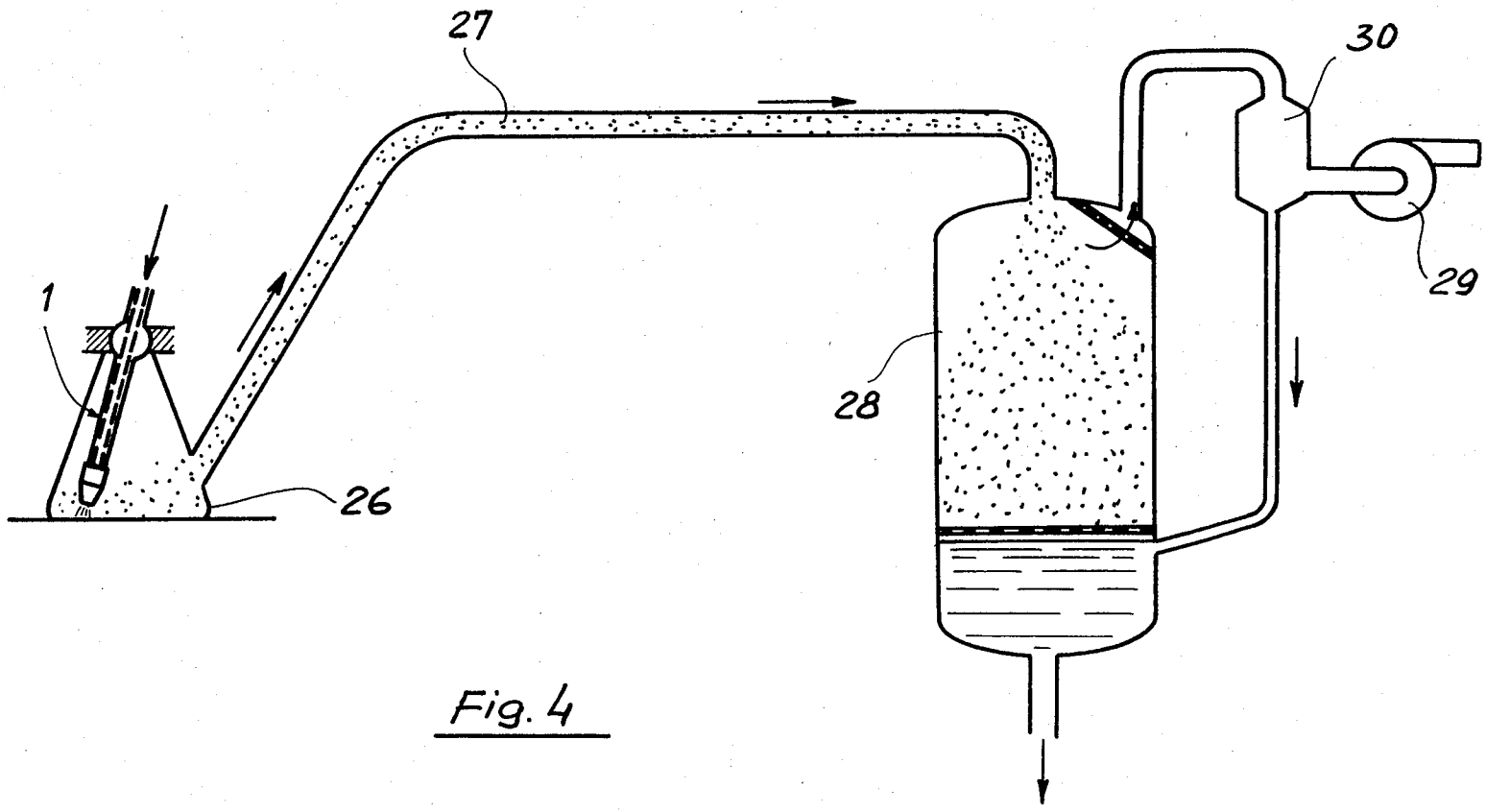
FIG. 4 is a sectional side view of a system operable to remove detritus and water from said surface.

The most effective measure, however, lies in the rapid evacuation of the detritus and the water from the scarification zone by means of energetic suction. For this purpose there is provided (FIG. 4) a suction outlet 26 which surrounds the scarification head and is connected by means of a flexible duct 27 to a reservoir 28 for storage of the detritus and separation of the water. A negative pressure or vacuum is maintained in this reservoir 28 by means of a fan actuated, for example, by the same motor which drives the high pressure pump. A cyclone separator 30 prevents the passage of water droplets in suspension.

As well as increasing the efficiency, the said suction installation allows the full exploitation of the following advantages to be obtained:

The removal and storage of the resultant material, therefore eliminating a troublesome operation; and (a) the recovery of the water and the possibility of its recycling, which is very important in regions where water is scarce, above all preventing, in the case of washing effected on motorways, the spreading of water into pools on the roadway alongside the work region, which may still be open to traffic;

(b) the creation of a point of negative pressure or vacuum which is connected to the de-gassing installation 6.

In practice, by means of the present apparatus it is possible not only to eliminate all of the deteriorated concrete, without producing damage to the good concrete, even in the presence of metal reinforcements which, rather, during the process is stripped of any rust which may be present, but at the same time there is the avoidance of vibrations and of any actions which may be dangerous to the structure, with consequent reduction of noise to a tolerable level; further, a highly roughened surface is created which even has cavities produced by the removal of rounded inert particles, which radically improves the grip of the renewed concrete; finally the formation of dust and fumes which accompanied the use of traditional methods is eliminated.

From what has been explained above, and from observation of the various figures of the attached drawings, the great functionality and practicality in use which characterises the hydraulic scarification apparatus constituting the subject of the present invention will be apparent.

Obviously, such apparatus has been described hereinabove and illustrated purely by way of indicative, and non limitative, example and only for the purpose of demonstrating the practicability and general characteristics of the present invention so that all those variations and modifications within the scope of an expert in the art, and susceptible of being introduced into the scope of the innovative concept explained above can be introduced thereto.

In particular, the necessary pressure of the water jets can be obtained by means of one or more stages, each of which can be preceded, if required, by a de-gassing installation and, possibly, by filtering.

What is claimed is:

1. A hydraulic scarification apparatus comprising a nozzle positioned at one end of a hollow shaft, a ball joint supporting said hollow shaft, high pressure pump means supplying water to said hollow shaft for delivery from said nozzle towards a surface to be scarified, degassing means positioned upstream of said high pressure pump, electronic control means operable to maintain said nozzle constantly at a predetermined height above the surface to be scarified, means for the removal of the scarified loose material and water from the region of impact of the water jet with the surface to be scarified, said nozzle being enclosed within a scarification head on which it is supported by said ball joint in such a way as to be freely movable within said scarification head, displacement of said nozzle being effected by nozzle displacement means including a linkage between said nozzle and said scarification head, said degassing means including a water container, a screen in said container, spray means operative to deliver water into said container, suction outlet means from said container leading to means for creating a partial vacuum in said container, said screen being positioned between said spray means and said suction outlet means whereby to prevent the passage of water droplets produced by said spray means, and level regulator means operating to control the flow of water to said spray means whereby to regulate the level of water in said container.

2. An apparatus according to claim 1, wherein said electronic control means for maintaining said nozzle at a predetermined height above the surface to be scarified comprise a detector and comparaison unit for detecting the height of said nozzle above said surface and comparing it with a predetermined height, and regulation means operable to control a fluid pressure actuator controlling the height of said nozzle in independence on the result of said comparison.

3. An apparatus according to claim 1, wherein said removal means comprises a suction system for withdrawing said scarified loose material and water from the region of impact of the water jet on the surface being scarified and comprising an aspiration opening which surrounds the scarification head, a flexible duct connecting said aspiration opening to a reservoir for retaining said scarified loose material and separating the water therefrom, means for generating a vacuum in said reservoir, and a cyclone separator between said reservoir and said vacuum generating means operable to impede the passage of water droplets suspended in the air flow from said reservoir to said vacuum generating means.

4. An apparatus according to claim 1, wherein there are provided multiple stage pressure generating means for pressurizing the water delivered to said nozzle, each stage of said multiple stage pressure generating means being preceded by a respective said degassing means.

* * * * *